US005796339A

United States Patent [19]

Drew et al.

[11] Patent Number: 5,796,339

[45] Date of Patent: Aug. 18, 1998

[54] SHOPLIFTING DETECTION LABEL DEACTIVATOR WITH COMBINED EXCITATION-DEACTIVATION COIL

[75] Inventors: Douglas A. Drew; Joerg W. Zschirnt, both of Boca Raton, Fla.

[73] Assignee: Sensormatic Electronics Corporation, Boca Raton, Fla.

[21] Appl. No.: 758,957

[22] Filed: Dec. 2, 1996

[51] Int. Cl.[6] ..... G08B 13/14

[52] U.S. Cl. ..... 340/572; 340/551

[58] Field of Search ..... 340/572, 551, 340/825.54

[56] References Cited

U.S. PATENT DOCUMENTS 3,624,631 11/1971 Chomet et al. ..... 340/572

4,779,076 10/1988 Weaver ..... 340/551

5,341,125 8/1994 Plonsky et al. ..... 340/572

5,495,229 2/1996 Balch et al. ..... 340/551

*Primary Examiner*—Jeffery Hofsass

*Assistant Examiner*—Sihong Huang

*Attorney, Agent, or Firm*—Robin, Blecker, Daley and Driscoll

[57] ABSTRACT

A deactivation device for use in an EAS system and comprising a detection transmit means operable to transmit a detection field into a detection/deactivation area, a detecting means operable to sense a signal from an EAS tag responsive to the detection field, and a deactivating means for transmitting a deactivating field into the detection/deactivation area operable to deactivate said active EAS tag, and wherein said detection transmit means and said deactivating means use a common coil to transmit the respective fields.

5 Claims, 7 Drawing Sheets

SHOPLIFTING DETECTION LABEL DEACTIVATOR WITH COMBINED EXCITATION-DEACTIVATION COIL

FIELD OF THE INVENTION

This invention relates to an electronic article surveillance (EAS) system, and in particular, to a deactivating device for use in such system.

BACKGROUND OF THE INVENTION

Electronic article surveillance (EAS) systems are known in which dual status EAS tags are attached to articles to be monitored. One type of dual status EAS tag comprises a length of high permeability, low coercive force magnetic material which is positioned substantially parallel to a length of a magnetizable material used as a control element. When an active tag, i.e. one having a demagnetized control element, is placed in an alternating magnetic field, which defines an interrogation zone, the tag produces a detectable valid tag signal. When the tag is deactivated by magnetizing its control element, the tag may produce a detectable signal which is different than the detectable valid tag signal.

Methods and apparatus of this type are described in U.S. Pat. No. 5,341,125. In the apparatus of the '125 patent, a deactivation device is used which includes a detection section which detects the presence of an active tag and a deactivation section which generates a strong magnetic pulse to deactivate the tag. The detection and deactivation sections utilize three coils. One coil is a detection receiving coil, another is a detection transmitting coil and a third is a deactivation coil. The detection transmitting coil generates a detection field for interacting with an active tag. The field resulting from this interaction is then detected by the detection receiving coil to sense the presence of the active tag. Once the active tag is found, the deactivation coil generates a deactivation field to deactivate the tag.

In using the deactivation device of the '125 patent for the above-described magnetic EAS tags, the transmitting coil is usually driven at frequencies below 1 kHz. At these frequencies, in order to generate the desired field strength efficiently, a large transmitting coil with many turns must be employed. The deactivation coil must even be larger, while the receiving coil can be somewhat smaller. The overall result is a deactivation device which is not as compact as possible, thereby limiting its use to only certain applications.

It is, therefore, a primary object of the present invention to provide an improved deactivation device for an EAS system.

It is a further object of the present invention to provide a deactivation device for an EAS system which is more compact.

SUMMARY OF THE INVENTION

In accordance with the principles of the present invention, the above and other objectives are realized in a deactivation device which comprises a detection transmit means for transmitting a detection field into a detection/deactivation area, a detection receive means for sensing a signal from an active EAS tag responsive to the detection field, and a deactivating means for transmitting a deactivating field into the detection/deactivation area to deactivate the EAS tag, and wherein said detection transmit means and the deactivation means use a common coil to transmit their respective fields.

BRIEF DESCRIPTION OF THE DRAWINGS

The above and other features and aspects of the present invention will become more apparent upon reading the following detailed description in conjunction with the accompanying drawings in which.

DETAILED DESCRIPTION

Figure 1:
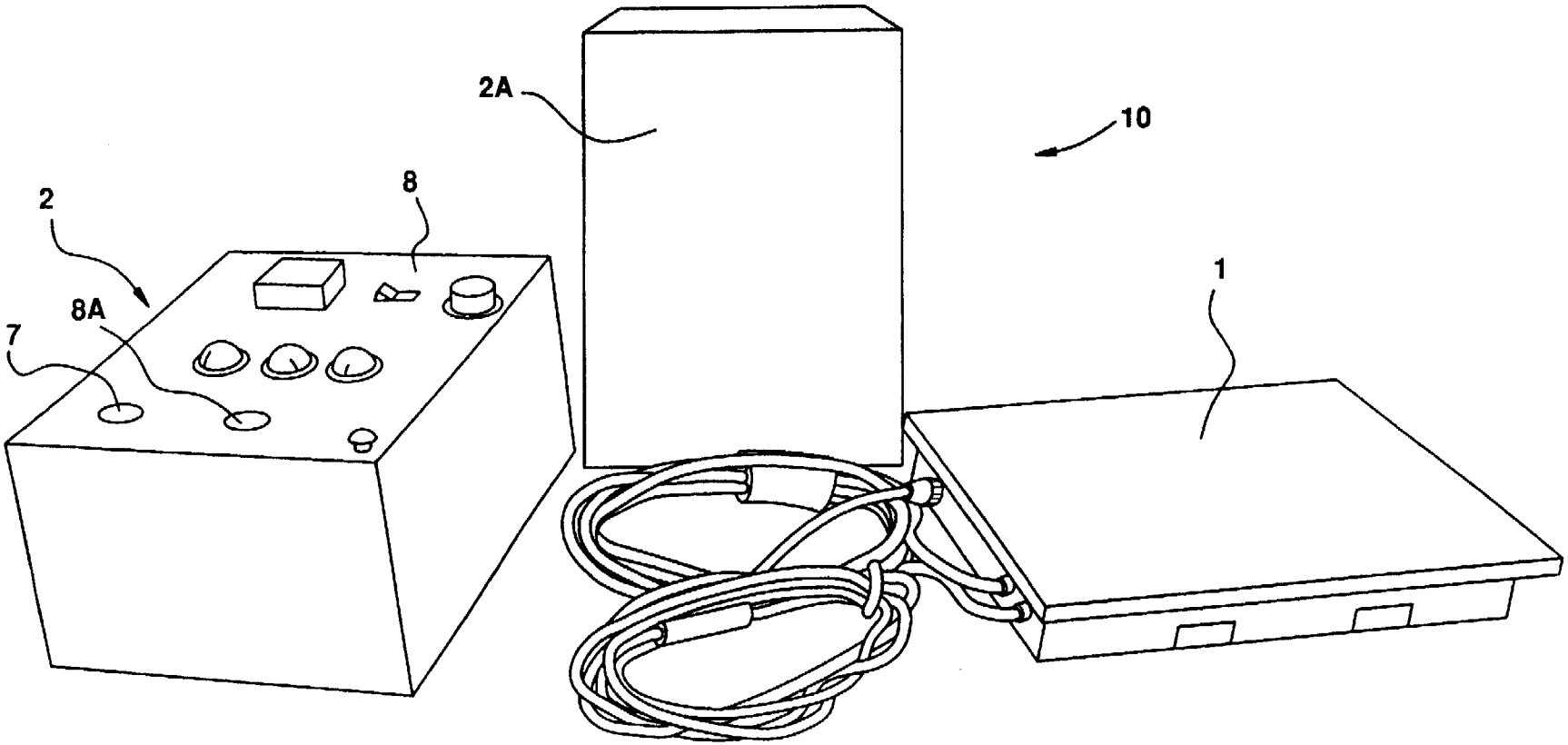
FIG. 1 illustrates a deactivation device in accordance with the principles of the present invention.

FIG. 1 shows a deactivating device 10 in accordance with the principles of the present invention. As illustrated, the deactivation device 10 comprises an electronics unit 2 which supplies signals to and receives signals from a detector/deactivator pad 1. The electronics unit 2 has a cover 2A, a power supply 8, detection electronics 7 and deactivation electronics 8A.

Figure 2:
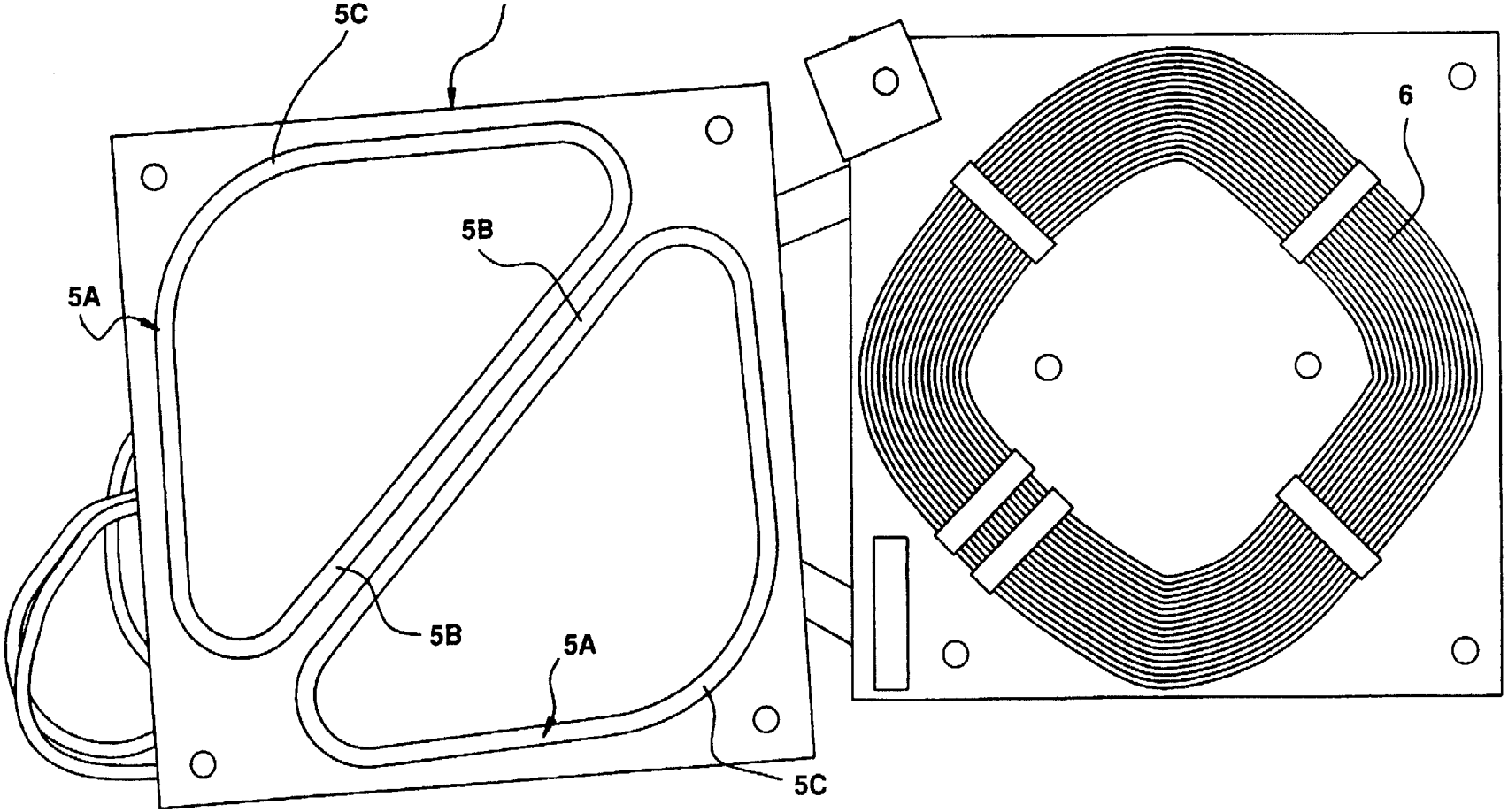
FIG. 2 illustrates the coil configuration for the deactivation device of FIG. 1 in greater detail.

As shown in FIG. 2, the detector/deactivator pad 1 employs a detection receiving coil 5. The coil 5 includes two adjacent planar coil parts 5A. Each coil part 5A has a straight segment 5B and a semicircular or arcuate segment 5C which connects the ends of the respective straight segment 5B. In conventional practice, the coil parts 5A are connected out-of-phase so as to cancel any transmit field which may be coupled thereto.

In accordance with the principles of the present invention, the pad 1 also includes a single coil 6 which acts both as a detection transmit coil and as a deactivation coil. The use of the single coil 6 for both these functions reduces the number of coils required in the pad 1 and, therefore, the size of the pad. As shown, the coil 6 is of square configuration.

Figure 3:
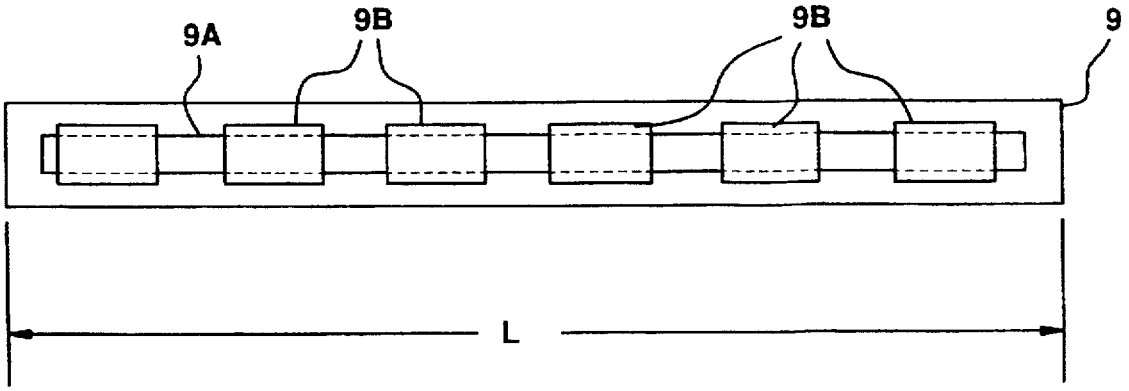
FIG. 3 shows a dual type EAS tag which can be deactivated with the deactivation device of FIG. 1.

FIG. 3 shows a typical form of a dual status magnetic tag 9 which can be deactivated by the deactivation device 10. As shown, the tag 9 comprises a response element 9A which can be a high permeability, low coercive force magnetic material. Positioned substantially overlapping and adjacent to the response element 9A are control elements 9B which can be comprised of a magnetizable material.

Figure 4A:
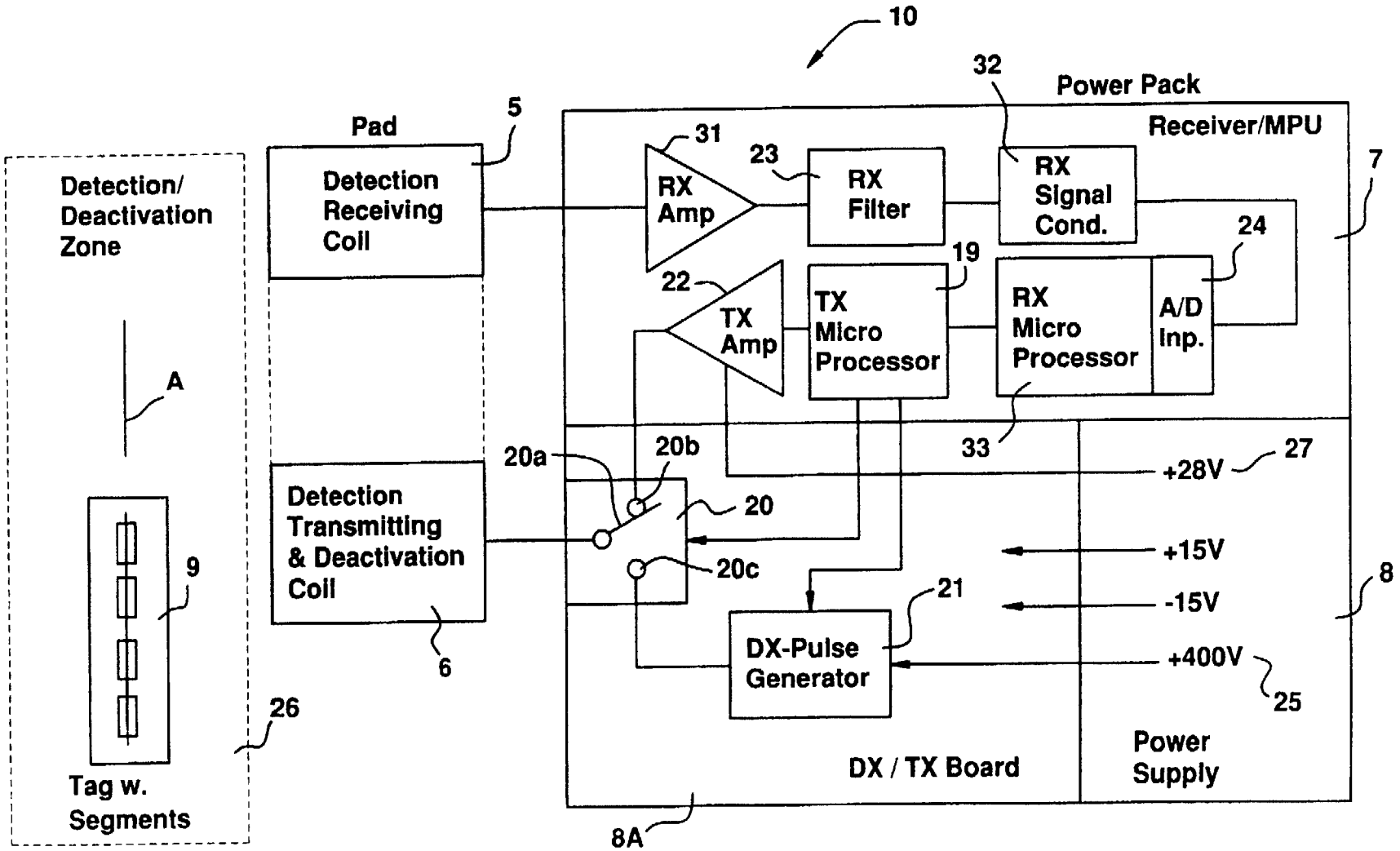
FIG. 4A shows a block diagram of the deactivation device of FIG. 1.

In FIG. 4A, which shows a block diagram of the deactivating device 10 of FIG. 1, the EAS tag 9 is situated in a detection/deactivation zone or area 26. The area 26 is defined by the device 10 and when the EAS tag 9 is within the area the tag can be detected and then deactivated.

As shown in FIG. 4A, the power supply 8 of the device 10 includes a number of separate power supplies which are used with the coil 6 when the coil is operating in its different modes of operation, i.e., as a detection transmitting coil and as a deactivation coil. More particularly, a high voltage power source 25, shown as a +400 voltage source, is used to supply power through a deactivation pulse generator 21 to the coil 6 when the coil is functioning as a deactivation coil. On the other hand, when the coil 6 is acting as a transmitting detection coil, a smaller power supply 27, shown as a +28 volt supply, supplies power to a transmit amplifier 22 which drives the coil.

In operation, to detect the presence of the tag 9 in the zone 26, the detection coil 6 is first driven at a predetermined frequency by the transmit amplifier 22. The latter amplifier, in turn, is responsive to a signal generated by a transmit microprocessor 19. When driven by the transmit amplifier 22, the detection coil 6 forms an alternating magnetic detection field in the zone 26. With the tag 9 is its active state and traversing the zone 26 along the path A, the tag 9 will generate a detectable response signal in at least one position along the path.

The detection receiving coil 5 is arranged to receive magnetic flux changes in the zone 26 and, thus, the detectable response signal generated by the tag 9. The received signals are coupled by the coil 5 to a receiving amplifier 31 and from this amplifier to a receiving filter 23 which isolates the detectable response signal generated by the tag. The output of the receiving filter 23 is conditioned in a receiver signal conditioner 32 and the conditioned signal passed to an analog to a digital input 24 of a receiver microprocessor 33. The microprocessor 33 determines when the received detectable response signal is greater than a threshold level, thereby detecting the presence of the tag 9 in the zone 26.

Upon detecting that the tag 9 is present in the zone 26, the microprocessor 33 initiates a deactivating sequence by signaling the transmit microprocessor 19. This signaling causes the microprocessor 19 to provide a signal to amplifier 22 which shuts off the amplifier so as to avoid switching transients. It then provides a deactivation control signal to a switch 20. The switch 20 couples either the transmit amplifier 22 or the deactivation pulse generator 21 to the coil 6 via connection of its switch element 20*a* to switch contacts 20*b* or 20*c*. Upon receipt of the deactivation control signal, the switch 20 moves its switch element from the contact 20*b* to the contact 20*c*, thereby connecting the deactivation pulse generator 21 to the transmitting/deactivating coil 6.

At this time the microprocessor 19 also transmits a control signal to the pulse generator 21, thereby causing the generator to generate a pulse. This pulse is then coupled through switch 20 to the coil 6. The coil 6 responsive to the pulse thereupon generates a deactivating electromagnetic field in the detection/deactivation zone 26.

The coil 6 is configured so that the deactivating electromagnetic field generated thereby substantially matches the range and the orientation of the magnetic detection field formed by the detecting coil 6 when in the detection transmitting mode. In this way, for positions or points within the zone 26, the magnetic flux lines of the deactivating field are in substantially the same direction as the magnetic flux lines of the magnetic detection field.

As a result, when the tag 9 is in a position in which the detection field results in a detectable response signal and, hence, has flux lines along the length of the tag, the flux lines of the deactivating field if generated will also be along the tag length. Application of the deactivating field at this detection position will thus establish flux lines along the length of the magnetizable control elements (control elements 9B) of the tag magnetizing the elements and, therefore, deactivating the tag. Accordingly, with the deactivating field matched to the detection field, detection of the tag 9 at any detection position along the path A and subsequent application of the deactivating field will result in deactivation of the tag at a deactivation position which is substantially at the detection position.

Figure 4B:
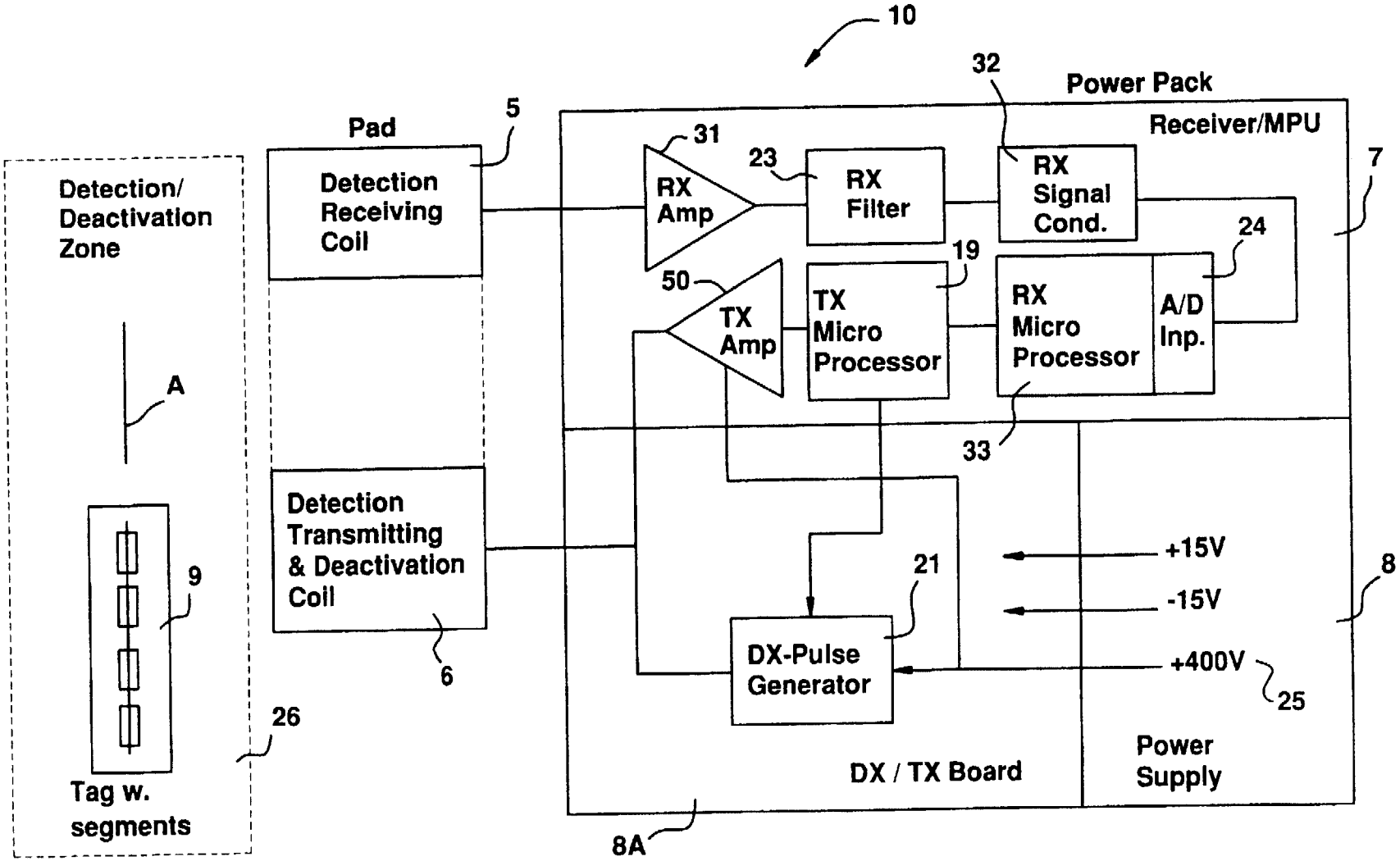
FIG. 4B shows a block diagram of an alternate embodiment of the deactivation device of FIG. 1.

FIG. 4B shows a second embodiment of deactivation device 10. This embodiment differs from the embodiment of FIG. 4A by the elimination of the switching device 20 and by the replacement of the amplifier 22 with a pulse width modulation transmit amplifier 50.

In this embodiment, the high voltage power supply 25 is used both during detection transmission and deactivation. Its output voltage must be sufficient to satisfy the deactivation voltage (approximately 300 volts peak), while the pulse width modulation amplifier 50 must be able to also generate a transmit signal with sufficient efficiency from this high voltage. Since a common power supply is used, the need for the switching device 20 is eliminated. This embodiment is advantageous for high detection transmit voltage levels.

In operation of the deactivation device 10 of FIG. 4B, for detecting the presence of the tag 9 in the zone 26, the coil 6 is driven at a predetermined frequency by the amplifier 50. Upon detecting that the tag 9 is present, the microprocessor 33 initiates a deactivating sequence by signaling the microprocessor 19. The latter microprocessor then provides a signal to the amplifier 50, shutting off the amplifier. It also signals the pulse generator 21 causing the pulse generator to apply a high power pulse to the coil 6. This action results in energizing coil 6 which causes a deactivating electromagnetic field to be formed in the zone 26, thereby deactivating the tag 9.

The switch 20 of the device 10 can be implemented as an electronic power analog switch (back-to-back power MOS FETs) or as a simple relay switch. The transmitting amplifier 22 can be a standard linear power amplifier or a class D (PWM type), while the amplifier 50 is required to be a Class D (PWM/switched mode) amplifier for efficient voltage conversion (step down from 300 V to 30 V).

Figure 5A:
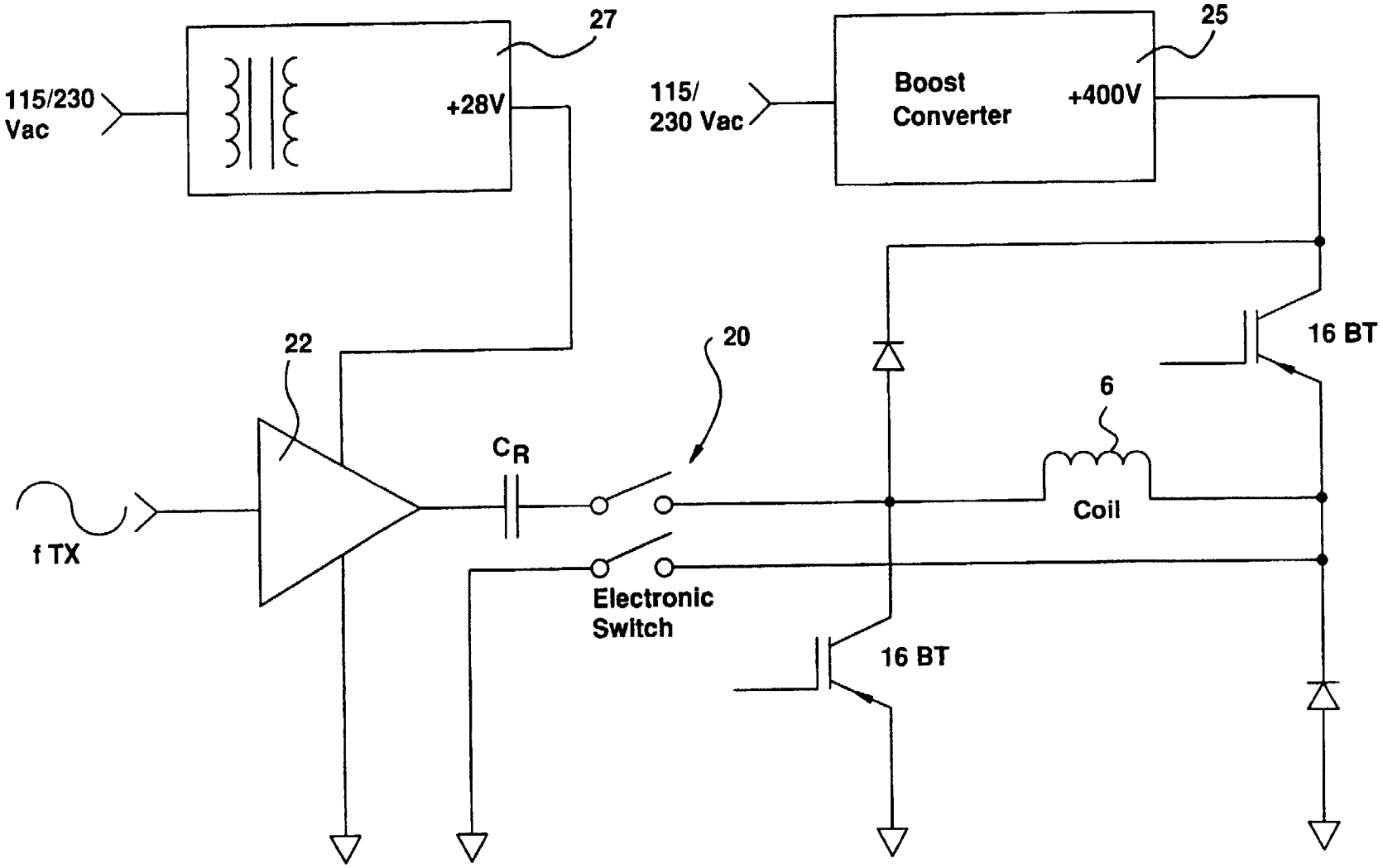
FIG. 5A shows a circuit configuration for realizing certain of the components of the deactivation device of FIG. 4A.
Figure 5B:
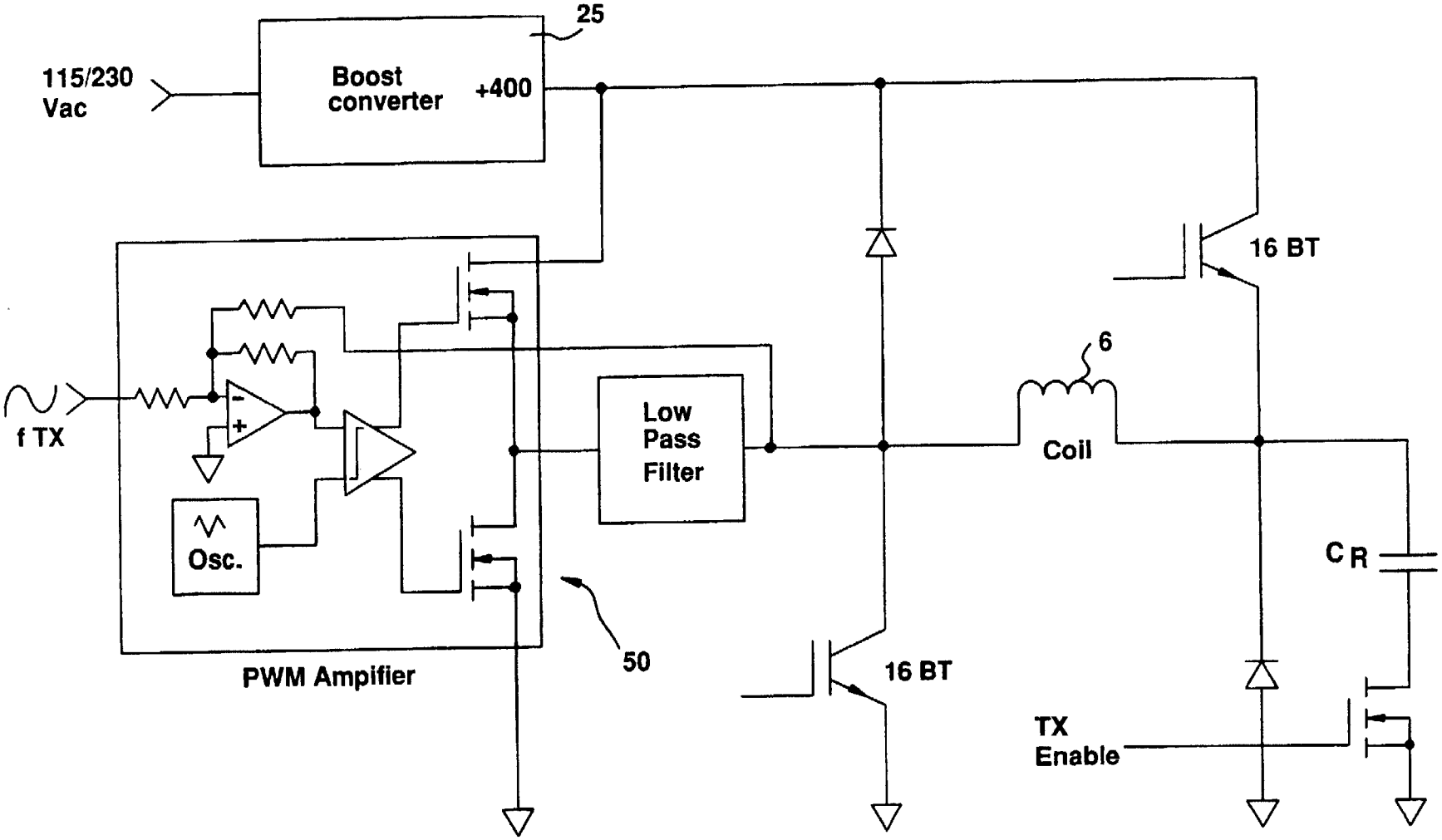
FIG. 5B shows a circuit configuration for realizing certain of the components of the deactivation device of FIG. 4B.

FIGS. 5A and 5B, respectively, illustrate actual circuit configurations for the switch 20 and its associated components of FIG. 4A and for the PWM amplifier 50 and its associated components of FIG. 4B.

In all cases it is understood that the above-described arrangements are merely illustrative of the many possible specific embodiments which represent applications of the present invention. Numerous and varied other arrangements can readily be devised in accordance with the principles of the present invention without departing from the spirit and scope of the invention.

What is claimed is:

1. A deactivation device for use in an EAS system utilizing a deactivatable type EAS tag, for sensing and deactivating the EAS tag positioned in a detection/deactivation area, said deactivation device comprising:

a detection transmit means for transmitting a detection field into said detection/deactivating area;

a detection receive means for sensing a signal from said EAS tag responsive to said detection field;

a deactivating means for transmitting a deactivating field into the detection/deactivation area to deactivate said EAS tag, and wherein said detection transmit means and said deactivating means use a common coil to transmit the respective fields;

said detection transmit means including an amplifier adapted to be responsive to a power supply for supplying power to said amplifier, and a switch, said switch being connected between said amplifier and said common coil;

said deactivating means including a pulse generator adapted to be responsive to a high power supply for supplying power to said pulse generator, said pulse generator being connected to said switch;

and control means for controlling said amplifier, said switch and said pulse generator.

2. The deactivation device of claim 1 wherein:

said control means includes microprocessor means.

3. The deactivation device in accordance with claim 1 wherein said common coil is a square coil.

4. A deactivation device for use in an EAS system utilizing a deactivatable type EAS tag, for sensing and deactivating the EAS tag positioned in a detection/deactivation area, said deactivation device comprising:

a detection transmit means for transmitting a detection field into said detection/deactivation area;

a detection receive means for sensing a signal from said EAS tag responsive to said detection field;

a deactivating means for transmitting a deactivating field into the detection/deactivation area to deactivate said EAS tag, and wherein said detection transmit means and said deactivating means use a common coil to transmit the respective fields;

said detection transmit means including a pulse width modulation amplifier adapted to be responsive to a high power supply for supplying power to said pulse width modulation amplifier, said pulse width modulation amplifier being connected to said common coil;

said deactivation means including a pulse generator adapted to be responsive to said high power supply for supplying power to said pulse generator, said pulse generator being connected to said common coil;

and a control means controlling said pulse width modulator amplifier and said pulse generator.

5. The deactivation device in accordance with claim 4 wherein:

said control means includes microprocessor means.

* * * * *